US008349471B2

(12) United States Patent
Tsunezawa et al.

(10) Patent No.: US 8,349,471 B2
(45) Date of Patent: Jan. 8, 2013

(54) HIGH-STRENGTH COLD-ROLLED STEEL SHEET EXCELLENT IN WORKABILITY AND SHAPE FREEZING PROPERTY

(75) Inventors: Michitaka Tsunezawa, Kakogawa (JP); Yuichi Futamura, Kakogawa (JP); Masaaki Miura, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/718,397

(22) Filed: Mar. 5, 2010

(65) Prior Publication Data

US 2010/0247958 A1 Sep. 30, 2010

(30) Foreign Application Priority Data

Mar. 31, 2009 (JP) ..... 2009-088088

(51) Int. Cl.
*B32B 15/04* (2006.01)
*B32B 15/18* (2006.01)
*C22C 38/00* (2006.01)

(52) U.S. Cl. ..... 428/659; 428/684; 420/8; 420/120; 148/320

(58) Field of Classification Search ..... 428/659, 428/681, 682, 683, 684
See application file for complete search history.

(56) References Cited

U.S. PATENT DOCUMENTS

| | | | | |
|---|---|---|---|---|
| 6,319,338 | B1 | 11/2001 | Kawano et al. | |
| 2002/0179193 | A1 * | 12/2002 | Yokoi et al. | 148/332 |
| 2006/0130937 | A1 * | 6/2006 | Ikeda et al. | 148/320 |

FOREIGN PATENT DOCUMENTS

| | | | |
|---|---|---|---|
| CN | 101155939 | A | 4/2008 |
| EP | 1 365 037 | A1 | 11/2003 |
| EP | 1 382 702 | A1 | 1/2004 |
| EP | 1 870 482 | A1 | 12/2007 |
| JP | 11-61326 | | 3/1999 |
| JP | 11-189839 | | 7/1999 |
| JP | 11-350064 | | 12/1999 |
| JP | 2004-218025 | | 8/2004 |
| JP | 2007-154283 | | 6/2007 |

OTHER PUBLICATIONS

Machine Translation, Kono et al., JP 11-189839, Jul. 1999.*
U.S. Appl. No. 12/983,482, filed Jan. 3, 2011, Futamura.
Chinese Office Action issued Jul. 27, 2011, in Patent Application No. 201010117001.6 (with English-language translation).

* cited by examiner

*Primary Examiner* — Michael La Villa
(74) *Attorney, Agent, or Firm* — Oblon, Spivak, McClelland, Maier & Neustadt, L.L.P.

(57) ABSTRACT

A high-strength cold-rolled steel sheet with improved TS-EL balance, springback value, workability and shape freezing properties having:

a steel content including 0.10-0.20 mass % C, 0.5-2.5 mass % Si, 0.5-2.25 mass % Mn, and 0.01-0.10 mass % Al;

a structure comprising (A) a mother phase structure of ferrite and (B) a second phase structure of retained austenite optionally including martensite; and satisfying the following expressions (1) and (2):

$$(Vf \times V\gamma \times C\gamma \times \text{dis})/\text{dia} \geqq 300 \quad (1),$$

$$\text{dis} \geqq 1.0\ \mu\text{m} \quad (2);$$

where Vf (%) is the volume fraction of the ferrite, Vγ (%) is the volume fraction of the retained austenite, Cγ (mass %) is the carbon content in the retained austenite, dis (μm) is the shortest distance between the second phase structures, and dia (μm) is the average grain size of the second phase structures.

4 Claims, 4 Drawing Sheets

HEAT TREATMENT PATTERN AND ABBREVIATIONS DURING ANNEALING

SCHEMATIC VIEW OF THREE-POINT U-BENDING TEST

HIGH-STRENGTH COLD-ROLLED STEEL SHEET EXCELLENT IN WORKABILITY AND SHAPE FREEZING PROPERTY

FIELD OF THE INVENTION

The present invention relates to a high-strength cold-rolled steel sheet, a hot-dip galvanized steel sheet, and an alloyed hot-dip galvanized steel sheet, which are excellent in workability and shape freezing property and have a tensile strength of about 550 to 900 MPa. More specifically, the present invention relates to a technology to improve a TRIP (Transformation Induced Plasticity) steel sheet having an excellent workability and a low springback value in a low strain region. A high-strength cold-rolled steel sheet according to the present invention: is useful as a high-strength steel sheet constituting the base material (raw material) of a hot-dip galvanized steel sheet or an alloyed hot-dip galvanized steel sheet; and is preferably used, for example, for automobile structural members (body frame members such as a pillar, a member, a reinforcement, and the like and strengthening members such as a bumper, a door guard bar, a seat part, a foot component, and the like) and household electrical appliances, those requiring a high workability.

BACKGROUND OF THE INVENTION

A steel sheet used for an automobile and an industrial machine by press-forming is required to have both a high strength and a high workability (good balance between strength and elongation) from the viewpoint of the improvement of collision safety and the improvement of fuel efficiency and the weight reduction of a vehicle body accompanied by environmental issues. As a high-strength steel sheet excellent in workability, a TRIP steel sheet is used. The TRIP steel sheet is a steel sheet in which an austenitic structure is retained, the retained austenite ($\gamma_R$) is induced-transformed into martensite by stress and strain, and thereby a large elongation is obtained.

In the meantime, an automobile structural member such as a member to absorb collision energy is required to have an excellent shape freezing property in bending or hat-shaped bending work in addition to the above properties. The shape freezing property means the property of freezing (preventing) the change of the shape caused by springback after a steel sheet is worked.

A problem however is that in general, as the strength of a steel sheet increases, the springback value increases after working and the shape freezing property deteriorates. In a TRIP steel sheet in particular, it is said that, since portions where retained austenite transforms into martensite and portions where retained austenite does not transform into martensite appear unevenly in the interior of the steel sheet after forming, a large residual stress is generated and a springback value increases.

Consequently, studies have been worked on in order to provide a TRIP steel sheet having a higher shape freezing property while maintaining a good workability.

For example, JP-A No. 61326/1999 discloses that a work hardening coefficient (an n value in 5% to 10% strain) of a steel sheet is useful as an index of the collision safety of an automobile member and, by controlling the average crystal grain size of retained austenite to 5 μm or less, it is possible to obtain a high strength and a high elongation (TS×EL≧20,000) and provide a TRIP steel sheet having a high n value.

JP-A No. 154283/2007 discloses a high-strength steel sheet in which the springback value is low and the residual stress after forming is lower than ever before while a high formability is maintained by mainly comprising a ferrite phase and an austenite phase of 3% or more and controlling the ratio of the portion having an aspect ratio of 2.5 or less in crystal grains at the portion other than the ferrite phase.

The present applicants also disclose technologies in JP-A Nos. 350064/1999 and 218025/2004, for example. In JP-A No. 350064/1999, a TRIP steel sheet in which the steel sheet comprises the three phases of ferrite, martensite, and 1% to 5% retained austenite and the hardness of the martensite is controlled is disclosed. Then in JP-A No. 218025/2004, a TRIP steel sheet having a combined structure comprising tempered martensite and ferrite as the mother phase in which the quantity of retained austenite that transforms into martensite by applying 2% strain in the retained austenite (retained austenite that has a low C content and unstable in the retained austenite) is precisely controlled is disclosed.

SUMMARY OF THE INVENTION

An object of the present invention is to provide a high-strength cold-rolled steel sheet, which is a TRIP steel sheet containing retained austenite, excellent in workability and shape freezing property, in which TS-EL balance is improved and the springback value is reduced in a high-strength region of about 550 to 900 MPa class (the springback value is reduced particularly in a low strain region).

A cold-rolled steel sheet according to the present invention that solves the above problems: contains, as the steel components, C: 0.10% to 0.20% (% means mass %, the same is applied hereunder), Si: 0.5% to 2.5%, Mn: 0.5% to 2.5%, and Al: 0.01% to 0.10% with the remainder consisting of iron and unavoidable impurities; has a structure comprising a mother phase structure of ferrite and a second phase structure of retained austenite and martensite (the martensite may not be included); and satisfies the following expressions (1) and (2) when the volume fraction of the ferrite in the whole structure is represented by Vf (%), the volume fraction of the retained austenite in the whole structure is represented by Vγ (%), the carbon content in the retained austenite is represented by Cγ (mass %), the shortest distance between the second phase structures is represented by dis (μm), and the average grain size of the second phase structures is represented by dia (μm), $$(Vf \times V\gamma \times C\gamma \times \mathrm{dis})/\mathrm{dia} \geqq 300 \quad (1),$$

$$\mathrm{dis} \geqq 1.0\ \mu\mathrm{m} \quad (2).$$

In a preferable embodiment of the cold-rolled steel sheet: the volume fraction Vf (%) of the ferrite in the whole structure is 60% or more; the volume fraction Vγ (%) of the retained austenite in the whole structure is 5.0% to 20%; the carbon content Cγ (mass %) in the retained austenite is 0.7% or more; and the average grain size dia (μm) of the second phase structures is 5 μm or less.

The present invention includes a hot-dip galvanized steel sheet obtained by applying hot-dip galvanizing to the cold-rolled steel sheet.

Further, the present invention includes an alloyed hot-dip galvanized steel sheet obtained by applying alloying hot-dip galvanizing to the cold-rolled steel sheet.

By the present invention, since the steel components and the structure are controlled appropriately, it is possible to provide a high-strength cold-rolled steel sheet excellent in both TS-EL balance and shape freezing property. More specifically, by the present invention, since a work hardening coefficient at the early stage of working (an n value in 0.5% to 1.0% strain) is kept relatively low and a work hardening coefficient at the late stage of working (an n value in 5% to 10% strain) is kept relatively high, the springback value after forming is kept low. Consequently, a high-strength cold-rolled steel sheet according to the present invention is very useful as a raw material for an automobile structural member such as a member strongly requiring a shape freezing property in bending or hat-shaped bending work.

DETAILED DESCRIPTION OF THE PREFERRED EMBODIMENTS

Figure 1:
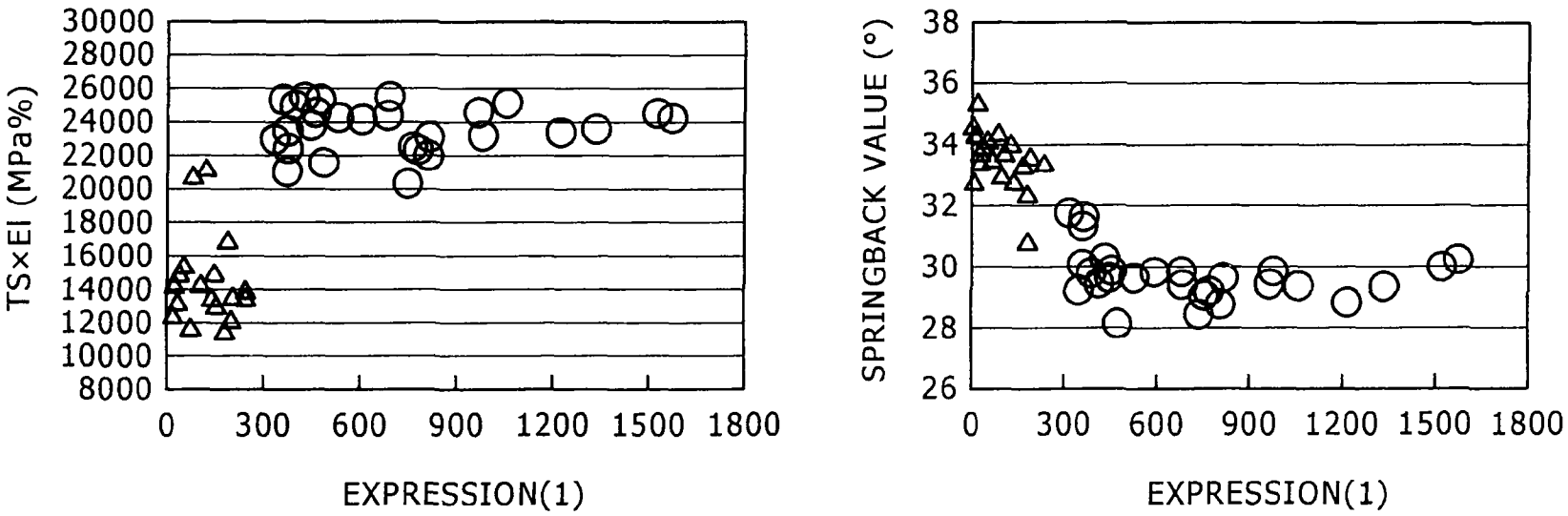
FIG. 1 comprises graphs showing the relationship of a TS×EL value and a springback value respectively with the expression (1) stipulated in the present invention.

The present inventors have worked on studies in order to provide a TRIP steel sheet excellent in workability (TS×EL balance) and shape freezing property. In particular, the studies have been worked on from the viewpoint of securing a good workability and a good shape freezing property by keeping a work hardening coefficient under a low strain at the early stage of working (an n value in 0.5% to 1.0% strain) relatively low and a work hardening coefficient under a high strain from the middle stage to the late stage of the working (an n value in 5% to 10% strain) relatively high. The reason is that, although the improvement of an n value under a high strain has heretofore been studied in many cases, an n value at the early stage of strain has not sufficiently been considered and hence a problem has been that the springback value cannot be reduced effectively against warping or twisting during press working.

As a result of the studies, it has been found that, if good properties are wanted to be secured by appropriately controlling a work hardening coefficient n value from the early stage to the late stage of working, only individual control of known parameters useful for the improvement of TS×EL balance is insufficient and appropriate control of "the shortest distance dis between second phase structures" to which attention has not heretofore been paid from the viewpoint of workability and others is extremely important.

This is explained in detail. It is known that, in general, TS×EL balance can be enhanced and a good workability can be secured by increasing the ferrite volume fraction (Vf) and the retained austenite volume fraction (Vγ) in a structure to the utmost and increasing the carbon content (Cγ) in the retained austenite to the utmost. Further, it is also known that the reduction and fractionization of a retained austenite grain size are effective. It has been found however that those controlling means are insufficient for providing a TRIP steel sheet having a shape freezing property in addition to the above properties. For example, it has been found as a result of the studies by the present inventors that twisting and warping occur during press forming in a low strain region of about 0.5% to 2% and, only by the control of the above requirements, deforming stress is reduced insufficiently in the low strain region and the shape freezing property is inferior.

In view of the above situation, various studies have further been worked on in order to provide a TRIP steel sheet excellent in both workability and shape freezing property by reducing deforming stress particularly in a low strain region. As a result: it has been found that, in a TRIP steel sheet having a structure comprising a mother phase structure of ferrite and a second phase structure of retained austenite and martensite (the martensite may not be included), the movement of dislocations is not hindered at the early stage of strain, hence deforming stress is kept sufficiently low at the early stage of the strain, and an intended object can be attained by controlling the structure so as to satisfy the following expressions (1) and (2) when the volume fraction of the ferrite in the whole structure is represented by Vf (%), the volume fraction of the retained austenite in the whole structure is represented by Vγ (%), the carbon content in the retained austenite is represented by Cγ (mass %), the shortest distance between the second phase structures is represented by dis (μm), and the average grain size of the second phase structures is represented by dia (μm), $$(Vf \times V\gamma \times C\gamma \times \mathrm{dis})/\mathrm{dia} \geqq 300 \quad (1),$$

$$\mathrm{dis} \geqq 1.0\ \mu\mathrm{m} \quad (2);$$

and the present invention has been completed.

In the present specification, for the convenience of explanation, the value of "(Vf×Vγ×Cγ×dis)/dia" on the left side of the above expression (1) is called a P value occasionally.

Here, the expressions (1) and (2) are very useful as parameters representing the superiority of both workability and a shape freezing property. As shown in the after-mentioned example, it has been found that, even though either the expression (1) or the expression (2) is satisfied, it is impossible to improve both workability and a shape freezing property simultaneously and the intended properties can be exhibited only when both the expressions (1) and (2) are satisfied.

For reference, the relationship of the above expression (1) with a TS×EL value as an index of workability and a springback value as an index of a shape freezing property is graphically shown in FIG. 1. The figure is produced by plotting the results in the after-mentioned example. In the figure, a symbol ○ represents an example of the present invention in which both the above expressions (1) and (2) are satisfied and a symbol Δ represents a comparative example in which the above expression (1) is not satisfied. As shown in FIG. 1, it is understood that the expression (1) has a very good correlation with both a TS×EL value and a springback value and that the TS×EL value and the springback value change largely when the P value reaches 300.

Here, the shortest distance dis between second phase structures stipulated in the expression (2): is specified by the present inventors as a new index contributing to the improvement of workability and a shape freezing property; and is included in the numerator of the P value in the expression (1). Further as stipulated in the expression (1), in the present invention, the constituent requirements contributing (or not contributing) to the improvement of workability and a shape freezing property are not controlled individually but controlled in total.

The technological significance in each of the expressions is hereunder explained in detail.

Firstly in the expression (1), the requirements constituting the numerator "(Vf×Vγ×Cγ×dis)", namely the volume fraction Vf (%) of ferrite in the whole structure, the volume fraction Vγ (%) of retained austenite in the whole structure, the carbon content Cγ (mass %) in the retained austenite, and the shortest distance dis (μm) between the second phase structures are set as positive (plus) constituent requirements contributing to the improvement of workability and a shape freezing property respectively. That is, according to the results of the studies by the present inventors, it has been found that, by controlling the volume fraction Vγ of retained austenite having a high carbon content Cγ to be high, the volume fraction Vf of ferrite to be high, and the average of the shortest distance dis between adjacent structures of retained austenite and martensite constituting the second phase structures to be large, the movement of dislocations in the ferrite governing ductility particularly at the early stage of strain and the discharge of secondary dislocations are not hindered, hence the deforming stress at the early stage of the strain is kept low, and a high work hardening is maintained from the middle stage to the late stage of working.

In contrast, in the expression (1), the average grain size dia of the second phase structures that is a parameter constituting the denominator is set as a negative (minus) constituent requirement contributing to the improvement of workability and a shape freezing property. That is, according to the results of the studies by the present inventors, it has been found that, retained austenite and martensite constituting the second phase structures and having large average grain sizes prevent the movement of dislocations in the ferrite governing ductility particularly at the early stage of strain or, even if dislocations move, localize (restrict) the movement of the dislocations, and hence it is impossible to keep the deforming stress low at the early stage of strain and maintain a high work hardening from the middle stage to the late stage of working.

The expression (1) is set on the basis of the above knowledge and many fundamental experiments conducted by the present inventors. In the expression (1), the product of the positive (plus) constituent requirements contributing to the improvement of workability and a shape freezing property is set as the numerator, the negative (minus) constituent requirements is set as the denominator, and the lower limit (P value is 300) of the expression (1) for obtaining a desired property is specified.

The larger the P value "(Vf×Vγ×Cγ×dis)/dia", the better, and a preferable P value is 400 or more and a yet preferable P value is 500 or more. The upper limit of the P value is not particularly limited from the viewpoint of the improvement of workability and a shape freezing property and is appropriately set on the basis of desirable ranges of the parameters constituting the P value respectively. In consideration of cost increase caused by the excessive addition of alloying elements and additional processes for fractionizing the structure, the upper limit of the P value is preferably 1,800 and yet preferably 1,600.

Successively, the technological significance of the expression (2) is explained.

According to the results of the studies conducted by the present inventors, it has been found that, in order to obtain a high-strength steel sheet excellent in both workability and a shape freezing property, only the setting of the expression (1) is insufficient and, unless particularly the shortest distance dis between the second phase structures in the constituent requirements constituting the P value is controlled to 1.0 μm or more, the discharge of secondary dislocations between ferrite structures reduces during working and a desired property is not obtained. In the case of No. 52 in Table 2 in the after-mentioned example, although the P value is 391 and the expression (1) is satisfied, the dis is 0.9 μm and the expression (2) is not satisfied and hence the TS×EL balance and the springback value as an index of a shape freezing property increase.

Here, a dis is the average of the shortest distances when the second phase structures (retained austenite and martensite) are identified in a scanning electron microscopic (SEM) photograph and the distances between the second phase structures observed adjacently in the manner of interposing the mother phase structures of ferrite are measured. That is, the dis is obtained as described below. With regard to one grain in a photograph, the distance between the grain and a grain closest to the grain is measured and the measured distance is defined as "the shortest distance" of the grain. "The shortest distance" of each of all grains in the photograph is obtained. Then the average of the obtained "shortest distances" is computed and is used as the dis. The "distances between the second phase structures" include not only the distances between retained austenite grains and the distances between martensite grains but also distances between the retained austenite grains and the martensite grains. The measuring method is described in detail in the after-mentioned example.

The lower limit of a dis is 1.0 μm. The larger the dis, the better and the dis is preferably 1.2 μm or more and yet preferably 1.4 μm or more. In consideration of the deterioration of ductility caused by the lowering of the quantity of retained γ however, the dis is controlled to preferably 7.0 μm or less, and yet preferably 6.0 μm or less.

The expressions (1) and (2) that most characterize the present invention are explained above.

In the present specification, "high strength" means that tensile strength is about 550 to 900 MPa.

In the present specification, "excellent in workability" means the case where a TS×EL value is about 20,000 or more (preferably about 22,000 or more) although the value changes in accordance with a strength level. More specifically, elongation (EL) is preferably about 30% or more in the case of a steel sheet having a strength of a 550 MPa class (not less than 550 to less than 780 MPa) and about 28% or more in the case of a steel sheet having a strength of a 780 MPa class (not less than 780 to less than 900 MPa).

In the present specification, "excellent in shape freezing property" means that a springback value is 32° or less when the springback value is measured in a U-bending test described in the after-mentioned example.

Further, in the present invention, the following expression (3) is stipulated as an index to evaluate both TS×EL balance and a shape freezing property from the early stage to the late stage of working. In the expression, both a work hardening coefficient in a low strain region "an n value (0.5% to 1.0%)" and a work hardening coefficient in a high strain region "an n value (5% to 10%)" are included and that the expression (3) is satisfied means that the n value at the early stage of strain is relatively low and the n value at the late stage of strain is relatively high.

$$TS \times EL \times n\ \text{value}(5\%\ \text{to}\ 10\%)/n\ \text{value}(0.5\%\ \text{to}\ 1.0\%) \geqq 20{,}000 \quad (3)$$

Figure 2:
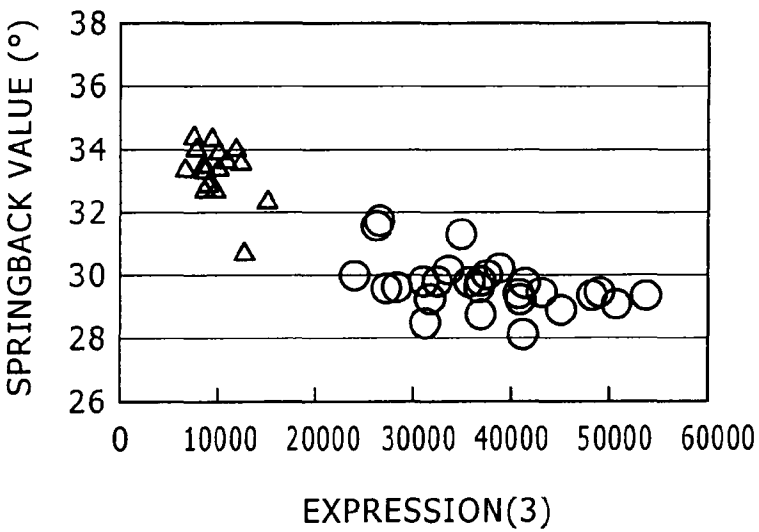
FIG. 2 comprises graphs showing the relationship of a TS×EL value and a springback value respectively with the expression (3) stipulated in the present invention.
Figure 2:
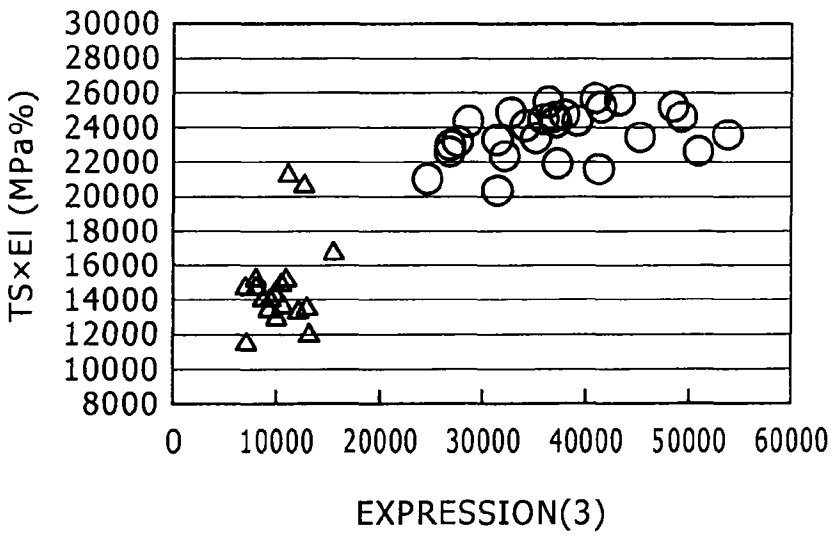

For reference, the relationship of the expression (3) with a TS×El value as an index of workability and a springback value as an index of a shape freezing property is graphically shown in FIG. 2. The figure is produced by plotting the results in the after-mentioned example. In the figure, a symbol ○ represents an example of the present invention in which the expression (3) is satisfied and a symbol Δ represents a comparative example in which the expression (3) is not satisfied.

As shown in FIG. 2, it is understood that the expression (3) has a very good correlation with both a TS×EL value and a springback value.

The present invention includes not only a cold-rolled steel sheet but also a hot-dip galvanized steel sheet (GI steel sheet) and an alloyed hot-dip galvanized steel sheet (GA steel sheet). By applying such plating, corrosion resistance improves.

The structure and steel components of a steel sheet according to the present invention are explained hereunder.

(Structure)

A steel sheet according to the present invention has a mother phase structure of ferrite and a second phase structure of retained austenite and martensite (the martensite may not be included). The present invention makes it possible to improve workability and a shape freezing property in a TRIP steel sheet having such structures.

Mother Phase Structure: Ferrite

A "mother phase" means a phase that accounts for half or more of a whole structure (a main phase) and is ferrite in the present invention. Ferrite contributes to the improvement of elongation (EL) and is also a structure useful in reducing a springback value caused by working in a low strain region by the movement of dislocations and the discharge of secondary dislocations and improving TS×EL balance. In the present invention, ferrite includes both polygonal ferrite (PF) and bainitic ferrite (BF). In the present invention, the larger the proportion of the polygonal ferrite in ferrite, the better, and it is preferable to obtain "ferrite mainly comprising polygonal ferrite" containing the polygonal ferrite by about 50% or more (yet preferably about 70% or more).

Further, the volume fraction Vf of ferrite (sum of PF and BF) in a whole structure is preferably 60% or more. If Vf is less than 60%, deformation concentrates into a small amount of ferrite at the early stage of deformation, a high n value cannot be maintained from the middle stage to the late stage of deformation, and the TS×EL balance lowers. A preferable range of Vf is appropriately determined by the balance with the second phase structure and is in the range of about 65% to 90% and yet preferably in the range of 70% to 85%.

Second Phase Structure: Retained Austenite and Martensite (Martensite may not be Included)

A "second phase structure" means retained austenite and martensite (the martensite may not be included). That is, in the present invention, at least retained austenite is included. The retained austenite is useful in improving elongation. Further as it will be described later, the appropriate control of a carbon content Cγ in the retained austenite and the appropriate control of the shortest distance dis between the second phase structures including the retained austenite and the average grain size dia of the second phase structures also contribute to the reduction of a springback value caused by working in a low strain region and the improvement of the TS×EL balance.

Here, the volume fraction Vγ of the retained austenite in a whole structure is preferably in the range of 5.0% to 20%. If Vγ is less than 5.0%, a high n value is not maintained from the middle stage to the late stage of deformation and the TS×EL balance deteriorates. A yet preferable Vγ is 7% or more. If Vγ exceeds 20% however, in a steel sheet in which the upper limit of a C content in steel is 0.20% like a steel according to the present invention, the highest C content in the retained austenite is only about 0.5 mass % at most and stable retained austenite is not obtained. Consequently, the retained austenite transforms into martensite at the early stage of strain and the TS×EL balance deteriorates. A yet preferable Vγ is 15% or less.

A carbon content Cγ in the retained austenite is preferably 0.7 mass % or more. The reason is that, if Cγ is less than 0.7%, the retained austenite transforms into martensite at the early stage of strain and the TS×EL balance deteriorates. From the viewpoint of the improvement of TS×EL balance, the more the Cγ, the better, and Cγ is yet preferably 0.8 mass % or more. The upper limit of Cγ is not particularly limited, can be determined from a C content in steel and the like, and is about 1.5 mass % or less.

In a second phase structure, besides the retained austenite, martensite may further be included. That is, the second phase structure either may be composed of only retained austenite or may be a combined structure comprising retained austenite and martensite. The reason is that, as stated above, TS×EL balance and a shape freezing property are improved by appropriately controlling the shortest distance dis between the second phase structures including martensite and the average grain size dia of the second phase structures. When martensite is further included, the volume fraction Vm of martensite in a whole structure is preferably about 30% or less.

The average grain size dia of the second phase structures is preferably 5 μm or less. The reason is that, if dis exceeds 5 μm, stress concentrates at the early stage of working and thereby the TS×EL balance and the springback value at the early stage of strain lower. The smaller the dia value, the better, and for example the dia value is yet preferably 4 μm or less. Here, the lower limit of dia is not particularly limited but, in consideration of cost increase caused by adding production processes due to excessive fractionization and others, the lower limit is preferably about 3 μm.

Here, a dia value is obtained by: identifying second phase structures (retained austenite and martensite) in a photograph taken with a scanning electron microscope (SEM); measuring the major axis and the minor axis of each of the second phase grains; using the average of the major axis and the minor axis as the average grain size of each structure; measuring the average grain sizes of all the second phase structures observed in the SEM photograph; and computing the average of all the average grain sizes. The measuring method is described in detail in the after-mentioned example.

A steel sheet according to the present invention may comprise only the mother phase structure and the second phase structure or may further include another structure (a remainder structure) to the extent of not hindering the function of the present invention. The "another structure" is a remainder structure unavoidably produced in the production processes for example and the typical examples are pearlite and bainite. The content of the "another structure" is preferably about 5 volume % in total. The reason is that, carbon exists abundantly in the structure of the pearlite and the bainite and hence either the quantity of the retained austenite contributing to the improvement of TS×EL balance reduces or the carbon content Cγ in the retained austenite reduces.

(Steel Components)

Steel components in a steel sheet according to the present invention are explained hereunder.

C: 0.10% to 0.20%

C is an element to secure the strength of a steel sheet and contribute to the generation of retained austenite. If a C content is less than 0.10%, the above effects are not effectively exhibited. If a C content exceeds 0.20% in contrast, weldability deteriorates. Consequently in the present invention, a C content is stipulated in the above range. A preferable lower limit of a C content is 0.12% and a preferable upper limit thereof is 0.18%.

Si: 0.5% to 2.5%

Si is known as a solid solution strengthening element and is an element useful for the generation of retained austenite having a high C content. If a Si content is less than 0.5%, the above functions are not effectively exhibited. If a Si content exceeds 2.5% in contrast, the above functions are saturated and ductility lowers. Consequently in the present invention, a Si content is stipulated in the above range. A preferable lower limit of a Si content is 1.0% and a preferable upper limit thereof is 2.0%.

Mn: 0.5% to 2.5%

Mn is an element to stabilize austenite and an element to enhance the generation of stable retained austenite having a high C content and to improve TS×EL balance. If a Mn content is excessive however, the quantity of ferrite decreases in a steel sheet and ductility and TS-EL balance deteriorate. Consequently in the present invention, a Mn content is stipulated in the above range. A preferable lower limit of a Mn content is 1.0% and a preferable upper limit thereof is 2.0%.

Al: 0.01% to 0.10%

Al functions as a deoxidizing agent. In the present invention, the lower limit of an Al content is set at 0.01% in order to effectively exhibit the effect. If an Al content is excessive in contrast, the quantity of oxide-type inclusions increases and the surface quality of a steel sheet deteriorates and hence the upper limit of an Al content is set at 0.10%. A preferable lower limit of an Al content is 0.02% and a preferable upper limit thereof is 0.07%.

A steel sheet according to the present invention contains above components and the remainder consists of iron and unavoidable impurities. As the unavoidable impurities, elements unavoidably included in production processes and the like (for example, P, N, S, O, and others) are named.

With the aim of rendering additional properties, a steel sheet according to the present invention may contain elements other than the above elements (allowable elements) that are generally used in a TRIP steel sheet within the range not hindering the functions of the present invention. More specifically, with the aim of the enhancement of strength or the like, the steel sheet may contain Ni: about 0.5% or less, V: about 0.15% or less, Mo: about 0.5% or less, Cr: about 0.8% or less, Cu: about 0.5% or less, Al: about 2.0% or less, and B: about 0.01% or less.

A high-strength steel sheet according to the present invention is useful as a thin steel sheet such as an automobile steel sheet and the thickness thereof is preferably about 0.8 to 2.3 mm.

The present invention also includes galvanized steel sheets such as a hot-dip galvanized steel sheet and an alloyed hot-dip galvanized steel sheet. Further, an organic film such as a film laminate, a chemical conversion treatment such as a phosphate treatment, or a painting treatment may be applied to the galvanized steel sheets. In particular, a galvanized steel sheet to which a chemical conversion treatment is applied as the primary treatment prior to a painting treatment is preferably used.

As paint used for the painting treatment, a known resin, such as an epoxy resin, a fluororesin, a silicon acrylic resin, a polyurethane resin, an acrylic resin, a polyester resin, a phenolic resin, an alkyd resin, or a melamine resin, is used. An epoxy resin, a fluororesin, and a silicon acrylic resin are preferably used from the viewpoint of corrosion resistance. A hardening agent may be used together with the above resins. Further, the paint may contain a known additive such as a coloring pigment, a coupling agent, a leveling agent, a sensitizing agent, an anti-oxidizing agent, an ultraviolet stabilizer, or a fire retardant.

The type of paint is not particularly limited in the present invention and any type of paint such as solvent-based paint, water-based paint, water-dispersible paint, powdered paint, or electrodeposition paint can be used. The coating method is not particularly limited either and a dipping method, a roll coating method, a splaying method, a curtain-flow coating method, and electrodepositing method can be used. The thickness of a coating layer (a plated layer, an organic film, a chemical treatment film, a painted film, or the like) may be appropriately set in accordance with the application.

(Production Method)

A method for producing a steel sheet according to the present invention is explained hereunder.

In order to produce a steel sheet according to the present invention satisfying the above requirements, it is particularly important to appropriately control a coiling temperature (CT) after hot rolling and an annealing process after cold rolling and by so doing a TRIP steel sheet satisfying the above requirements is obtained.

Figure 3:
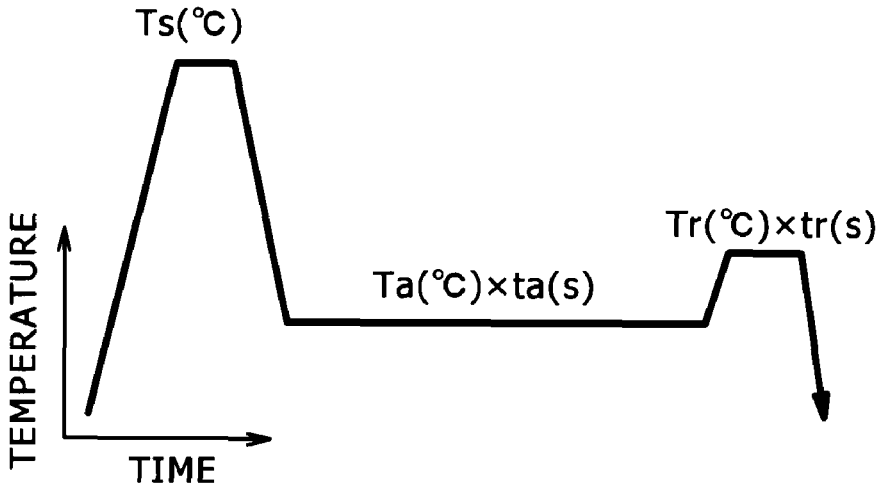
FIG. 3 is a schematic view showing a part of a heat pattern in the production of a steel sheet according to the present invention.

Processes featuring the present invention are hereunder explained in sequence. With regard to the annealing process among the processes, the outline of a heat pattern is shown in FIG. 3. Coiling temperature (CT) after hot rolling: 550° C. or lower If a coiling temperature exceeds 550° C., the structure of a hot-rolled steel sheet turns to comprise coarse ferrite and pearlite, the sizes of the second phase structures and the like increase after annealing, and an intended structure is hardly obtained. Further, the thickness of scale on the surface of the steel sheet increases and the pickling property deteriorates. A preferable coiling temperature CT is about 500° C. or lower. Here, the lower limit of CT is not particularly limited but, in consideration of the deterioration of productivity caused by excessive cooling during production, the lower limit thereof is preferably about 450° C.

Cold Reduction Ratio: 20% to 60%

If a cold reduction ratio is less than 20%, a thin and long hot-rolled steel sheet is required in order to obtain a steel sheet of an intended thickness and the productivity in pickling and the like deteriorate. If a cold reduction ratio exceeds 60% in contrast, recrystallization advances sufficiently at a low temperature during annealing (during heating), the nuclei of initiating reverse transformation into austenite reduce at the temperature of the succeeding double phase region, and it is impossible to finely disperse the second phase structures after annealing. A preferable cold reduction ratio is in the range of about 30% to 50%.

Heating Rate During Annealing: 0.5 to 5.0° C./sec

If an average heating rate is less than 0.5° C./sec during annealing, productivity deteriorates, recrytallization advances sufficiently at a low temperature during annealing, the nuclei of initiating reverse transformation into austenite reduce at the temperature of the succeeding double phase region, and it is impossible to finely disperse the second phase structures after annealing. If an average heating rate exceeds 5.0° C./sec during annealing in contrast, the heating temperature becomes uneven and the structure after annealing also becomes uneven. A preferable average heating rate is in the range of about 1.0 to 4.0° C./sec.

Soaking Temperature (Ts in FIG. 3): 840° C. to $Ac_3$ Temperature

If a soaking temperature Ts is lower than 840° C., the quantity of austenite in a double phase region lowers, a C content in austenite increases, hence ferrite is produced insufficiently in the succeeding cooling process, and the shortest distance dis between the second phase structures reduces. If a soaking temperature Ts exceeds the $Ac_3$ temperature in contrast, only an austenite single phase is formed when soaking is finished and a structure coarsens after annealing. A preferable soaking temperature Ts is in the range of about 850° C. to 880° C.

Here, the $Ac_3$ temperature is computed on the basis of the following expression. In the expression, (%) represents a content (mass %) of each element. The expression is described in "The physical metallurgy of Steels, William C Leslie" (published by Maruzen Co., Ltd., author William C Leslie, p 273).

$$Ac_3=910-203\sqrt{(\%\ C)}-15.2(\%\ Ni)+44.7(\%\ Si)+104(\%\ V)+31.5(\%\ Mo)+13.1(\%\ W)-30(\%\ Mn)-11(\%\ Cr)-20(\%\ Cu)+700(\%\ P)+400(\%\ Al)+120(\%\ As)+400(\%\ Ti)$$

Soaking Time (ts in FIG. 3): 30 Sec or Less

Here a soaking time means a residence time of a steel sheet in a temperature range of 840° C. or higher. If a soaking time ts exceeds 30 sec, retained austenite and martensite coarsen after annealing. A preferable soaking time ts is about 25 sec or less. Here, the lower limit of a soaking time ts is not particularly limited but, in consideration of the increase of the quantity of retained γ after annealing and the like, it is desirable to control the soaking time to about 20 sec.

Average Cooling Rate from Soaking Temperature Ts to Austempering Temperature Ta: 1 to 20° C./Sec If an average cooling rate from a soaking temperature Ts is less than 1° C./sec, pearlite harmful to the improvement of TS×EL balance and the like is generated during cooling. If a cooling rate from the Ts temperature exceeds 20° C./sec in contrast, the ferrite volume fraction reduces. A preferable average cooling rate is in the range of about 2 to 15° C./sec.

Here, in the above temperature range, two-step cooling in which different average cooling rates are applied may be adopted as shown in the after-mentioned example. More specifically, cooling may be applied at an average cooling rate of about 1 to 10° C./sec in the temperature range of a soaking temperature Ts to about 600° C. and successively at an average cooling rate of about 3 to 20° C./sec in the temperature range of about 600° C. to 390° C.

Austempering Temperature Ta: 300° C. to 390° C.

If an austempering temperature Ta is lower than 300° C., martensite is generated abundantly during cooling, bainite transformation delays, and the quantity of retained austenite reduces after annealing. If an austempering temperature Ta exceeds 390° C. in contrast, nuclei to initiate bainite transformation reduce and the second phase structure coarsens. An austempering temperature Ta is preferably in the range of about 320° C. to 390° C. and yet preferably in the range of 340° C. to 390° C.

Austempering Time ta: 30 to 1,000 Sec

Here, an austempering time means a residence time of a steel sheet in the temperature range of 300° C. to 390° C. If an austempering time ta is less than 30 sec, the time of bainite transformation shortens and the quantity of retained austenite reduces. If an austempering time ta exceeds 1,000 sec in contrast, productivity deteriorates. An austempering time ta is preferably in the range of about 35 to 500 sec and yet preferably in the range of 40 to 300 sec.

Average Heating Rate During Reheating after Austempering: 1 to 20° C./Sec

If an average heating rate is less than 1° C./sec during reheating, productivity deteriorates and, if it exceeds 20° C./sec, a structure becomes uneven after annealing due to temperature unevenness and the shortest distance dis between the second phase structures increases. An average heating rate is preferably in the range of about 2 to 15° C./sec and yet preferably in the range of 3 to 10° C./sec.

Reheating Temperature Tr: 450° C. to 550° C.

If a reheating temperature Tr is lower than 450° C., the acceleration of bainite transformation is insufficient and the quantity of retained austenite reduces. If a reheating temperature Tr exceeds 550° C. in contrast, untransformed austenite decomposes into ferrite and cementite and the quantity of retained austenite reduces after annealing. A reheating temperature Tr is preferably in the range of about 460° C. to 530° C.

Reheating Time tr: 100 Sec or Less

Here, a reheating time means a residence time of a steel sheet in the temperature range of 450° C. to 550° C. If a reheating time tr at 450° C. or higher exceeds 100 sec, untransformed austenite decomposes into ferrite and cementite and the quantity of retained austenite reduces after annealing. A reheating time tr is preferably 90 sec or less and yet preferably 80 sec or less. Here, the lower limit of the reheating time tr is not particularly limited but, in consideration of the promotion of bainite transformation and the like, is preferably about 20 sec.

Average Cooling Rate after Reheating: 1 to 50° C./Sec

If an average cooling rate after reheating is less than 1° C./sec, productivity deteriorates and, if it exceeds 50° C./sec, a structure becomes uneven after annealing due to the unevenness of temperature. An average cooling rate is preferably in the range of about 2 to 40° C./sec and yet preferably in the range of about 3 to 30° C./sec.

The above items are the requirements in the production processes characterizing the present invention. In the present invention in particular, it is necessary to precisely control a coiling temperature CT after hot rolling, a soaking process (a soaking temperature Ts and a soaking time ts), an austempering process (an austempering temperature Ta and an austempering time ta), and a reheating process (a reheating temperature Tr and a reheating time tr) after austempering and, if any one of those items deviates from the requirements of the present invention, a steel sheet having desired properties is hardly obtained (refer to the example described later).

Other processes than the above processes, such as hot rolling and cold rolling, may be applied in accordance with ordinary methods and it is possible to appropriately adopt ordinarily used methods so that an intended steel sheet may be obtained. Further, the present invention includes not only a cold-rolled steel sheet but also a hot-dip galvanized steel sheet and an alloyed hot-dip galvanized steel sheet, but it is not intended to limit the methods for hot-dip galvanizing and alloying hot-dip galvanizing and ordinarily used methods can be used.

Preferable embodiments according to the present invention are explained hereunder but it is not intended to limit the present invention to the embodiments.

Firstly, molten steel satisfying a composition according to the present invention is produced by a known melting and refining method with a converter or an electric furnace and formed into a semifinished product such as a slab by continuous casting or forging and breakdown rolling.

Successively, the semifinished product is hot-rolled. More specifically, either it is possible to apply hot rolling directly after continuous casting or, when the semifinished product is produced by continuous casting or forging and breakdown rolling, it is also possible to apply hot rolling after cooling it to an appropriate temperature and then heating in a reheating furnace.

A heating temperature at hot rolling is preferably about 1,100° C. or higher (yet preferably 1,150° C. or higher) and thereby steel components can easily dissolve uniformly in an austenitic structure. A finishing temperature at hot rolling is preferably $Ar_3$ point or higher and yet preferably $Ar_3$ point+(30-50) ° C.

After hot rolling, a hot-rolled steel sheet is coiled at a prescribed coiling temperature CT as stated earlier, thereafter pickled if necessary, and cold-rolled. Successively, an intended high-strength steel sheet is obtained by applying annealing and then cooling in a continuous annealing line as stated above.

A hot-dip galvanized steel sheet or an alloyed hot-dip galvanized steel sheet can be produced by using a high-strength cold-rolled steel sheet produced as above and applying hot-dip galvanizing or alloying hot-dip galvanizing on the basis of an ordinary method. With regard to the conditions of a plating bath, for example, a temperature of the plating bath is preferably in the range of about 400° C. to 600° C. (yet preferably 400° C. to 500° C.). When alloying is applied additionally, alloying treatment is applied for about 2 to 60 sec at about 450° C. to 600° C.

When a hot-dip galvanized steel sheet is produced, it is also possible to dip a cold-rolled steel sheet in a galvanizing bath before reheating is applied and then apply hot-dip galvanizing at the reheating process. Otherwise when an alloyed hot-dip galvanized steel sheet is produced, it is also possible to apply alloying treatment at the succeeding reheating process. The heating means is not particularly limited and commonly used various methods (for example, gas heating, induction heating, and the like) can be used.

EXAMPLES

The present invention is hereunder explained more concretely in reference to examples. The present invention however is not limited by the examples below and can be carried out by appropriately modifying the examples within the range conforming to aforementioned and after-mentioned tenor and the modifications are all included in the technological scope of the present invention.

Example 1

The steel types A to H having chemical compositions (the unit is mass % and the remainder consists of iron and unavoidable impurities) shown in Table 1 are produced by melting and refining and then slabs are obtained by casting the steels. The slabs are heated to 1,150° C., hot-rolled to a thickness of 2.4 mm at a finishing temperature of 880° C., thereafter cooled at an average cooling rate of 30° C./sec, and coiled at the coiling temperatures (CT) shown in Table 2. The hot-rolled steel sheets are pickled and thereafter cold-rolled to a thickness of 1.2 mm at a cold reduction ratio of 50%. Successively, the cold-rolled steel sheets are heated to the soaking temperatures (Ts) shown in Table 2 at an average heating rate of 5° C./sec and retained at the temperatures for the times (ts) shown in Table 2 with an experimental heat treatment apparatus that can simulate a continuous annealing line. Thereafter, the annealed steel sheets are cooled to 600° C. at an average cooling rate of 3° C./sec and thereafter subjected to austempering treatment by cooling the steel sheets to the austempering temperatures (Ta) shown in Table 2 at an average cooling rate of 10° C./sec and retaining the steel sheets at the temperatures for the austempering times (ta) of 3 to 1,000 sec. Thereafter, the steel sheets are heated to the reheating temperatures (Tr) shown in Table 2 at an average heating rate of 10° C./sec, retained for the times (tr) shown in Table 2, and thereafter cooled to room temperature at an average cooling rate of 10° C./sec.

With regard to each of the cold-rolled steel sheets thus obtained, the fractions of the structures, the dis, and the dia are measured as described below.

A test piece of 2 mm×20 mm×20 mm is cut out, a cross sectional plane parallel with the rolling direction is polished and corroded with a nital solution, and thereafter the structure at the t/4 position of the thickness t is observed in a SEM photograph (3,000 magnifications). Observation is applied to 10 visual fields in total, the size of each visual field being about 15 μm×15 μm.

Figure 4:
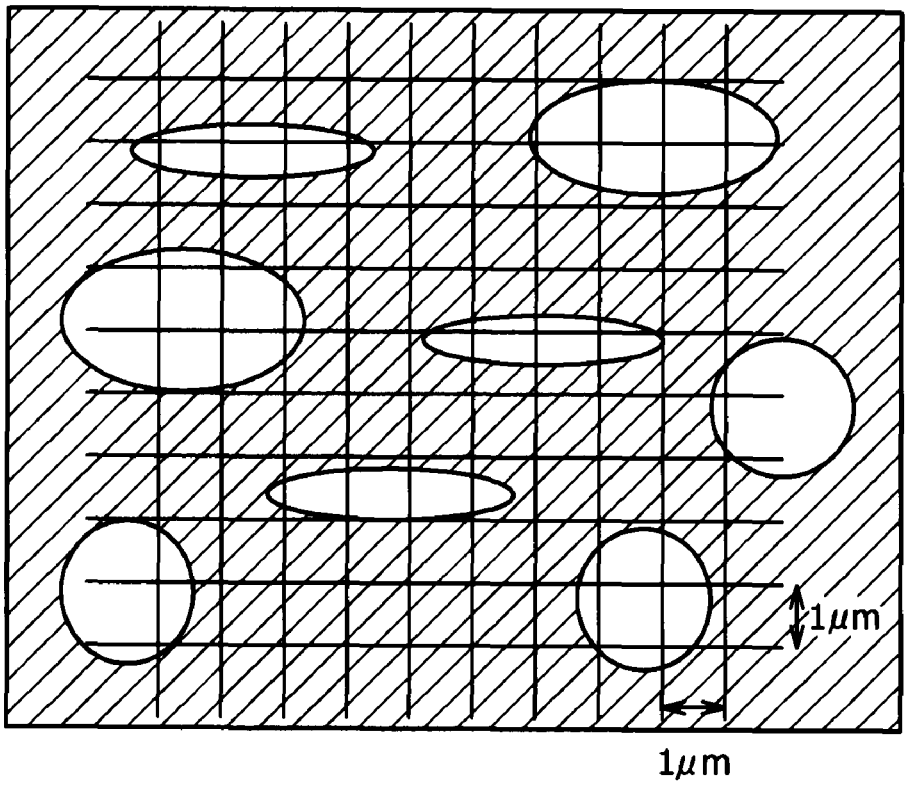
FIG. 4 is a view explaining the lattice intervals used for measuring a structure in the example.

With regard to each visual field on the SEM photograph, the volume fractions of ferrite, the second phase structure (retained austenite and martensite), and the other structure (remainder structure, described as "the other" in the table) are measured with lattices of 1 μm intervals shown in FIG. 4 by the point counting method. That is, the proportion of each structure is obtained by judging the structure at each point at which a vertical line and a horizontal line intersect with each other and totaling up the number of points in each structure over the whole visual field. The same procedure is applied to all the ten visual fields and the average is defined as the volume fraction of each structure.

Further, the shortest distance dis (μm) between the second phase structures and the average grain size dia (μm) of the second phase structures are measured on the aforementioned SEM photograph by the aforementioned method.

Meanwhile, the volume fraction Vγ of retained austenite is measured by a saturated magnetization measurement method. The details of the saturated magnetization measurement method are described in JP-A No. 90825/2003 and "R&D Kobe Steel Engineering Reports" (Vol. 52, No. 3, December 2002).

The volume fraction of martensite is computed by deducting the volume fraction of retained austenite from the volume fraction of the second phase structures.

Further, a carbon content Cγ (mass %) in retained austenite is obtained by using a test piece taken from a position of t/4, obtaining a lattice constant (Å) from the reflection angles of the (200) plane, the (220) plane, and the (311) plane of austenite by X ray analysis with a Cu—Kα ray, and substituting the lattice constant into the following expression, $$C\gamma=(\text{Lattice constant}-3.572)/0.033.$$

A P value "(Vf×Vγ×Cγ×dis)/dia" is computed from thus obtained Vf (volume %), Vγ (volume %), Cγ (mass %), dis (μm), and dia (μm).

Then with regard to each cold-rolled steel sheet, mechanical properties and a springback value are measured as follows.

(Measurement of Mechanical Properties)

A JIS #5 test piece (distance between gauge points: 50 mm, width of parallel portion: 25 mm) is taken out from each of the cold-rolled steel sheets and a tensile strength (TS), a total elongation (EL), and work hardening coefficients (an n value in 0.5% to 1.0% strain and an n value in 5% to 10% strain) are measured in accordance with JIS Z 2241. Here, the tension speed from 0.5% strain loading to breakage is kept constant at 10 mm/min. The product of thus obtained TS (MPa) and EL (%) is computed and a strength-ductility balance (TS×EL) is obtained. In the present example, a steel sheet is evaluated as being excellent in workability when the TS×EL balance is 20,000 or more.

(Measurement of Springback Value)

Figure 5:
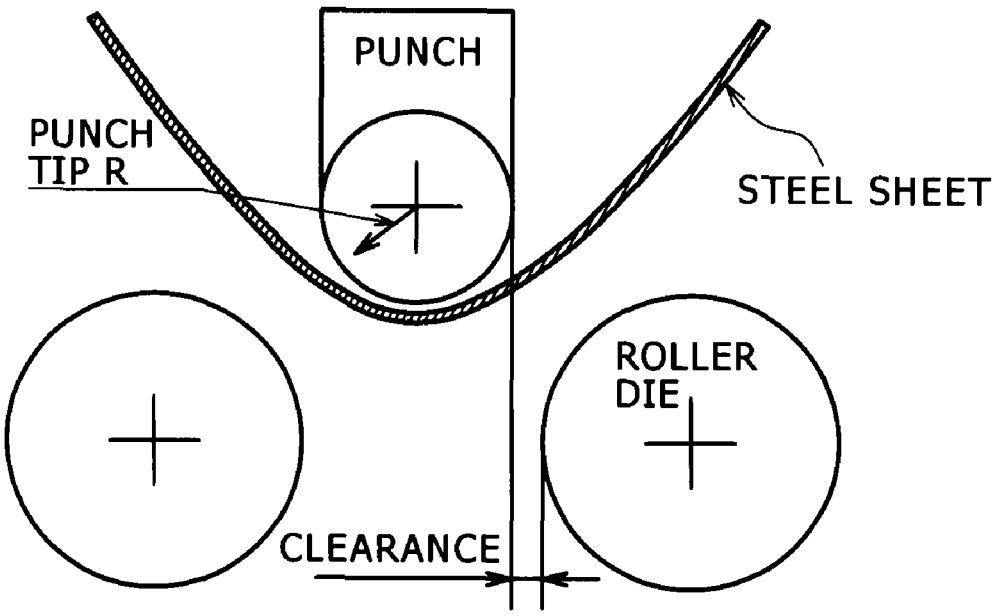
FIG. 5 is a view explaining the general concept of three-point U-bending test used for measuring a springback value in the example.
Figure 6:
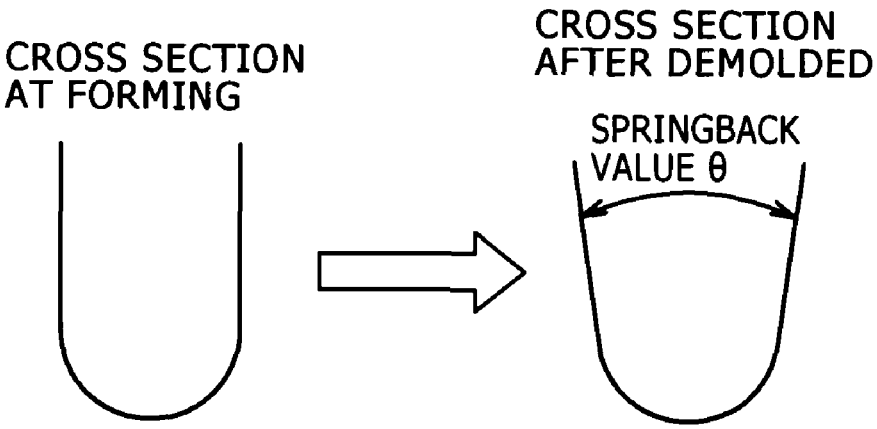
FIG. 6 is a view explaining the measurement of a springback value in the example.

Three-point U-bending test shown in FIG. 5 is carried out in order to measure a springback value in a low strain region. More specifically, the punch tip R is set at 20 mm, the clearance between a punch and a roller die is set at 1.2 mm, then U-bending test is applied so that the center of the punch tip R and the center of the die tip R may coincide with each other, and the bending test is terminated at 10 mm pushing. As shown in FIG. 6, an angle after springback (a state where elasticity is recovered after unloaded) is measured and the angle is defined as a springback value.

In the present example, a steel sheet is evaluated as "being excellent in shape freezing property" when the springback value is 32.0° or less and "being absolutely excellent in shape freezing property" when the springback value is 31.0° or less.

The results are collectively shown in Table 3.

TABLE 1

| Steel type | C | Si | Mn | Al | $Ac_3$ |
|---|---|---|---|---|---|
| A | 0.05 | 1.2 | 1.0 | 0.040 | 908 |
| B | 0.12 | 1.0 | 1.2 | 0.034 | 868 |
| C | 0.15 | 1.5 | 1.1 | 0.046 | 885 |
| D | 0.13 | 1.6 | 1.7 | 0.029 | 877 |
| E | 0.18 | 1.8 | 1.6 | 0.030 | 876 |
| F | 0.15 | 1.9 | 1.9 | 0.040 | 879 |
| G | 0.16 | 2.8 | 1.7 | 0.041 | 922 |
| H | 0.13 | 1.3 | 2.7 | 0.042 | 833 |

TABLE 2

| | | Coiling | Soaking | | Austempering | | Reheating | |
|---|---|---|---|---|---|---|---|---|
| No. | Steel type | CT (° C.) | Ts (° C.) | ts (Sec) | Ta (° C.) | ta (Sec) | Tr (° C.) | tr (s) |
| 1 | A | 500 | 860 | 20 | 360 | 60 | 510 | 10 |
| 2 | B | 450 | 860 | 20 | 370 | 45 | 480 | 15 |
| 3 | B | 400 | 840 | 25 | 390 | 1000 | 490 | 15 |
| 4 | C | 350 | 850 | 25 | 380 | 40 | 500 | 20 |
| 5 | C | 500 | 840 | 30 | 360 | 50 | 520 | 20 |
| 6 | D | 500 | 870 | 30 | 350 | 900 | 510 | 15 |
| 7 | D | 450 | 840 | 25 | 320 | 90 | 540 | 10 |
| 8 | D | 400 | 850 | 20 | 385 | 500 | 500 | 15 |
| 9 | E | 500 | 850 | 20 | 350 | 70 | 500 | 20 |
| 10 | E | 450 | 870 | 30 | 380 | 60 | 490 | 10 |
| 11 | E | 400 | 840 | 10 | 390 | 45 | 520 | 10 |

TABLE 2-continued

| | | Coiling | Soaking | | Austempering | | Reheating | |
|---|---|---|---|---|---|---|---|---|
| No. | Steel type | CT (° C.) | Ts (° C.) | ts (Sec) | Ta (° C.) | ta (Sec) | Tr (° C.) | tr (s) |
| 12 | E | 540 | 850 | 20 | 350 | 70 | 500 | 20 |
| 13 | E | 400 | 850 | 20 | 350 | 70 | 500 | 20 |
| 14 | E | 600 | 850 | 20 | 350 | 70 | 500 | 20 |
| 15 | E | 650 | 850 | 20 | 350 | 70 | 500 | 20 |
| 16 | E | 400 | 860 | 10 | 390 | 45 | 520 | 10 |
| 17 | E | 400 | 870 | 10 | 390 | 45 | 520 | 10 |
| 18 | E | 400 | 780 | — | 390 | 45 | 520 | 10 |
| 19 | E | 400 | 830 | — | 390 | 45 | 520 | 10 |
| 20 | E | 400 | 920 | 10 | 390 | 45 | 520 | 10 |
| 21 | E | 400 | 930 | 10 | 390 | 45 | 520 | 10 |
| 22 | E | 450 | 870 | 30 | 310 | 60 | 490 | 10 |
| 23 | E | 450 | 870 | 30 | 350 | 60 | 490 | 10 |
| 24 | E | 450 | 870 | 30 | 390 | 60 | 490 | 10 |
| 25 | E | 450 | 870 | 30 | 250 | 60 | 490 | 10 |
| 26 | E | 450 | 870 | 30 | 290 | 60 | 490 | 10 |
| 27 | E | 450 | 870 | 30 | 400 | 60 | 490 | 10 |
| 28 | E | 450 | 870 | 30 | 430 | 60 | 490 | 10 |
| 29 | E | 540 | 850 | 20 | 350 | 500 | 500 | 20 |
| 30 | E | 540 | 850 | 20 | 350 | 950 | 500 | 20 |
| 31 | E | 540 | 850 | 20 | 350 | 35 | 500 | 20 |
| 32 | E | 540 | 850 | 20 | 350 | 2 | 500 | 20 |
| 33 | E | 540 | 850 | 20 | 350 | 25 | 500 | 20 |
| 34 | E | 450 | 870 | 30 | 380 | 60 | 460 | 10 |
| 35 | E | 450 | 870 | 30 | 380 | 60 | 520 | 10 |
| 36 | E | 450 | 870 | 30 | 380 | 60 | 540 | 10 |
| 37 | E | 450 | 870 | 30 | 380 | 60 | 400 | 10 |
| 38 | E | 450 | 870 | 30 | 380 | 60 | 440 | 10 |
| 39 | E | 450 | 870 | 30 | 380 | 60 | 560 | 10 |
| 40 | E | 450 | 870 | 30 | 380 | 60 | 600 | 10 |
| 41 | E | 450 | 870 | 30 | 380 | 60 | 490 | 30 |
| 42 | E | 450 | 870 | 30 | 380 | 60 | 490 | 50 |
| 43 | E | 450 | 870 | 30 | 380 | 60 | 490 | 90 |
| 44 | E | 450 | 870 | 30 | 380 | 60 | 490 | 3 |
| 45 | E | 450 | 870 | 30 | 380 | 60 | 490 | 5 |
| 46 | E | 450 | 870 | 30 | 380 | 60 | 490 | 140 |
| 47 | E | 450 | 870 | 30 | 380 | 60 | 490 | 1000 |
| 48 | F | 500 | 850 | 10 | 350 | 100 | 490 | 10 |
| 49 | F | 500 | 870 | 30 | 400 | 150 | 490 | 10 |
| 50 | G | 540 | 840 | 10 | 330 | 30 | 530 | 100 |
| 51 | H | 450 | 850 | 20 | 350 | 50 | 500 | 70 |
| 52 | E | 400 | 800 | — | 390 | 35 | 500 | 10 |

TABLE 3

| | | Structure (fraction: volume %, Cγ: mass %) | | | | | | | | Tensile property | | | Springback | | | |
|---|---|---|---|---|---|---|---|---|---|---|---|---|---|---|---|---|
| No. | Steel type | Vf (%) | Vγ (%) | Vm (%) | The other (%) | Cγ (%) | dia (μm) | dis (μm) | Expression (1) | TS (MPa) | EI (%) | TS × EI | value (°) | n value (0.5-1.0%) | n value (5-10%) | Expression (3) |
| 1 | A | 90 | 2.1 | 7.9 | 0.0 | 0.7 | 3.2 | 5.0 | 192 | 551 | 22 | 12122 | 30.8 | 0.15 | 0.16 | 12930 |
| 2 | B | 84 | 7.3 | 8.7 | 0.0 | 0.9 | 3.5 | 3.1 | 483 | 673 | 32 | 21536 | 28.1 | 0.11 | 0.21 | 41114 |
| 3 | B | 85 | 8.9 | 6.1 | 0.0 | 0.9 | 3.0 | 3.5 | 812 | 729 | 30 | 21870 | 28.7 | 0.13 | 0.22 | 37011 |
| 4 | C | 83 | 9.1 | 7.9 | 0.0 | 1.0 | 3.3 | 3.3 | 778 | 743 | 30 | 22290 | 29.1 | 0.14 | 0.20 | 31843 |
| 5 | C | 84 | 9.0 | 7.0 | 0.0 | 1.0 | 3.2 | 3.2 | 748 | 701 | 29 | 20329 | 28.4 | 0.13 | 0.20 | 31275 |
| 6 | D | 88 | 10.1 | 1.9 | 0.0 | 0.9 | 2.9 | 2.8 | 764 | 803 | 28 | 22484 | 29.0 | 0.12 | 0.27 | 50589 |
| 7 | D | 87 | 11.2 | 1.8 | 0.0 | 1.0 | 2.4 | 3.2 | 1338 | 812 | 29 | 23548 | 29.4 | 0.11 | 0.25 | 53518 |
| 8 | D | 85 | 10.6 | 4.4 | 0.0 | 1.0 | 2.7 | 3.0 | 971 | 789 | 31 | 24459 | 29.4 | 0.12 | 0.24 | 48918 |
| 9 | E | 75 | 11.4 | 13.6 | 0.0 | 1.0 | 3.4 | 1.6 | 394 | 866 | 29 | 25114 | 29.8 | 0.14 | 0.23 | 41259 |
| 10 | E | 78 | 12.4 | 9.6 | 0.0 | 1.0 | 3.9 | 1.7 | 422 | 847 | 30 | 25410 | 29.4 | 0.13 | 0.22 | 43002 |
| 11 | E | 79 | 11.2 | 9.8 | 0.0 | 1.0 | 3.8 | 1.6 | 358 | 845 | 30 | 25350 | 29.2 | 0.13 | 0.21 | 40950 |
| 12 | E | 80 | 10.2 | 9.8 | 0.0 | 1.0 | 3.5 | 2.0 | 462 | 847 | 29 | 24563 | 29.6 | 0.14 | 0.21 | 36845 |
| 13 | E | 76 | 10.8 | 13.2 | 0.0 | 1.0 | 2.7 | 1.9 | 601 | 862 | 28 | 24136 | 29.8 | 0.13 | 0.20 | 37132 |
| 14 | E | 78 | 7.8 | 14.2 | 0.0 | 0.9 | 7.3 | 1.9 | 139 | 880 | 17 | 14960 | 34.0 | 0.23 | 0.16 | 10407 |
| 15 | E | 69 | 7.0 | 24.0 | 0.0 | 0.8 | 8.6 | 2.2 | 101 | 899 | 16 | 14384 | 34.4 | 0.25 | 0.17 | 9781 |
| 16 | E | 75 | 10.5 | 14.5 | 0.0 | 1.0 | 3.3 | 2.9 | 685 | 842 | 29 | 24418 | 29.8 | 0.15 | 0.22 | 35813 |
| 17 | E | 73 | 10.2 | 16.8 | 0.0 | 1.0 | 3.2 | 4.5 | 1058 | 837 | 30 | 25110 | 29.4 | 0.13 | 0.25 | 48288 |
| 18 | E | 70 | 7.5 | 22.5 | 0.0 | 0.9 | 3.0 | 0.9 | 134 | 791 | 17 | 13447 | 34.0 | 0.19 | 0.17 | 12032 |
| 19 | E | 73 | 7.7 | 19.3 | 0.0 | 0.8 | 4.5 | 1.9 | 197 | 802 | 17 | 13634 | 33.6 | 0.17 | 0.16 | 12832 |
| 20 | E | 60 | 5.6 | 34.4 | 0.0 | 0.8 | 8.6 | 3.3 | 103 | 891 | 16 | 14256 | 33.0 | 0.23 | 0.15 | 9297 |
| 21 | E | 55 | 4.5 | 40.5 | 0.0 | 0.8 | 9.2 | 3.2 | 67 | 900 | 13 | 11700 | 34.2 | 0.26 | — | — |
| 22 | E | 69 | 7.8 | 23.2 | 0.0 | 0.9 | 4.5 | 3.4 | 370 | 874 | 24 | 20976 | 30.0 | 0.18 | 0.21 | 24472 |
| 23 | E | 75 | 9.0 | 16.0 | 0.0 | 1.0 | 3.1 | 3.8 | 819 | 854 | 27 | 23058 | 29.6 | 0.16 | 0.19 | 27381 |

TABLE 3-continued

| | | Structure (fraction: volume %, Cγ: mass %) | | | | | | | | Tensile property | | | Springback | | | |
|---|---|---|---|---|---|---|---|---|---|---|---|---|---|---|---|---|
| No. | Steel type | Vf (%) | Vγ (%) | Vm (%) | The other (%) | Cγ (%) | dia (μm) | dis (μm) | Expression (1) | TS (MPa) | EI (%) | TS × EI | value (°) | n value (0.5-1.0%) | n value (5-10%) | Expression (3) |
| 24 | E | 82 | 11.2 | 6.8 | 0.0 | 1.1 | 2.8 | 4.2 | 1529 | 844 | 29 | 24476 | 30.0 | 0.13 | 0.20 | 37655 |
| 25 | E | 43 | 3.4 | 53.6 | 0.0 | 0.7 | 9.4 | 1.3 | 13 | 890 | 14 | 12460 | 34.6 | 0.31 | — | — |
| 26 | E | 56 | 4.5 | 39.5 | 0.0 | 0.7 | 7.9 | 1.7 | 39 | 878 | 17 | 14926 | 34.0 | 0.28 | 0.15 | 7996 |
| 27 | E | 70 | 7.7 | 22.3 | 0.0 | 0.8 | 6.7 | 1.9 | 118 | 850 | 25 | 21250 | 33.8 | 0.25 | 0.13 | 11050 |
| 28 | E | 72 | 6.8 | 21.2 | 0.0 | 0.7 | 6.8 | 1.5 | 77 | 864 | 24 | 20736 | 33.6 | 0.23 | 0.14 | 12622 |
| 29 | E | 83 | 11.6 | 5.4 | 0.0 | 1.0 | 3.3 | 2.3 | 691 | 821 | 31 | 25451 | 29.4 | 0.15 | 0.24 | 40722 |
| 30 | E | 85 | 12.4 | 2.6 | 0.0 | 1.1 | 3.1 | 3.4 | 1225 | 779 | 30 | 23370 | 28.8 | 0.13 | 0.25 | 44942 |
| 31 | E | 74 | 9.2 | 16.8 | 0.0 | 0.9 | 3.8 | 2.8 | 441 | 850 | 28 | 23800 | 30.2 | 0.14 | 0.20 | 34000 |
| 32 | E | 51 | 3.8 | 45.2 | 0.0 | 0.7 | 9.2 | 0.9 | 13 | 899 | 17 | 15283 | 34.4 | 0.29 | 0.15 | 7905 |
| 33 | E | 70 | 4.2 | 25.8 | 0.0 | 0.7 | 8.5 | 1.3 | 31 | 844 | 18 | 15192 | 33.6 | 0.25 | 0.17 | 10331 |
| 34 | E | 72 | 10.5 | 17.5 | 0.0 | 1.0 | 4.2 | 2.3 | 397 | 857 | 29 | 24853 | 29.8 | 0.16 | 0.21 | 32620 |
| 35 | E | 79 | 9.9 | 11.1 | 0.0 | 0.9 | 3.7 | 2.7 | 531 | 835 | 29 | 24215 | 29.6 | 0.17 | 0.20 | 28488 |
| 36 | E | 81 | 8.2 | 10.8 | 0.0 | 0.6 | 3.3 | 3.0 | 332 | 819 | 28 | 22932 | 31.7 | 0.18 | 0.21 | 26754 |
| 37 | E | 65 | 5.4 | 29.6 | 0.0 | 0.7 | 8.0 | 0.9 | 28 | 875 | 17 | 14875 | 33.4 | 0.26 | 0.12 | 6865 |
| 38 | E | 68 | 5.9 | 26.1 | 0.0 | 0.7 | 7.4 | 1.2 | 47 | 857 | 18 | 15426 | 33.6 | 0.24 | 0.17 | 10927 |
| 39 | E | 80 | 4.3 | 4.4 | 11.3 | 0.8 | 3.8 | 3.3 | 239 | 770 | 18 | 13860 | 33.4 | 0.24 | 0.18 | 10395 |
| 40 | E | 81 | 2.4 | 1.5 | 15.1 | 0.8 | 3.4 | 4.1 | 178 | 722 | 16 | 11552 | 33.4 | 0.25 | 0.15 | 6931 |
| 41 | E | 75 | 12.1 | 12.9 | 0.0 | 1.0 | 3.5 | 1.8 | 462 | 845 | 30 | 25350 | 29.8 | 0.14 | 0.20 | 36214 |
| 42 | E | 75 | 12.0 | 13.0 | 0.0 | 0.6 | 3.6 | 2.3 | 368 | 836 | 28 | 23408 | 31.3 | 0.14 | 0.21 | 35112 |
| 43 | E | 73 | 11.5 | 15.5 | 0.0 | 0.6 | 3.3 | 2.4 | 372 | 831 | 27 | 22437 | 31.6 | 0.16 | 0.19 | 26644 |
| 44 | E | 55 | 3.2 | 41.8 | 0.0 | 0.6 | 6.3 | 0.9 | 16 | 884 | 16 | 14144 | 32.8 | 0.24 | 0.15 | 8840 |
| 45 | E | 56 | 2.5 | 41.5 | 0.0 | 0.6 | 6.2 | 1.9 | 27 | 885 | 16 | 14160 | 33.4 | 0.23 | 0.14 | 8619 |
| 46 | E | 79 | 2.7 | 6.2 | 0.0 | 0.7 | 2.4 | 3.6 | 234 | 754 | 18 | 13572 | 33.4 | 0.24 | 0.16 | 9048 |
| 47 | E | 82 | 1.4 | 14.6 | 0.0 | 0.7 | 1.9 | 3.4 | 146 | 692 | 19 | 13148 | 32.8 | 0.23 | 0.17 | 9718 |
| 48 | F | 74 | 8.9 | 17.1 | 0.0 | 1.0 | 2.3 | 3.5 | 982 | 859 | 27 | 23193 | 29.8 | 0.17 | 0.23 | 31379 |
| 49 | F | 77 | 10.4 | 12.6 | 0.0 | 1.0 | 2.2 | 4.5 | 1572 | 837 | 29 | 24273 | 30.2 | 0.15 | 0.24 | 38837 |
| 50 | G | 69 | 4.9 | 26.1 | 0.0 | 1.1 | 4.3 | 2.1 | 183 | 889 | 19 | 16891 | 32.4 | 0.23 | 0.21 | 15422 |
| 51 | H | 45 | 6.7 | 48.3 | 0.0 | 0.7 | 9.7 | 1.4 | 28 | 953 | 14 | 13342 | 35.4 | 0.27 | — | — |
| 52 | E | 60 | 13.1 | 26.9 | 0.0 | 0.8 | 1.3 | 0.9 | 391 | 791 | 17 | 13447 | 34.0 | 0.20 | 0.17 | 11430 |

The following consideration is obtained from Tables 2 and 3.

Firstly, Nos. 2 and 3 (the steel type B is used), Nos. 4 and 5 (the steel type C is used), Nos. 6 to 8 (the steel type D is used), Nos. 9 to 13, 16, 17, 22 to 24, 29 to 31, 34 to 36, and 41 to 43 (the steel type E is used), and Nos. 48 and 49 (the steel type F is used) are the cases where the requirements in the present invention are satisfied. In any of them, the TS×EL balance exceeds 20,000 and is excellent in workability and the springback value is 31° or less and is absolutely excellent in shape freezing property.

Here, Nos. 36, 42, and 43 (the steel type E is used) are excellent in both workability and shape freezing property since they satisfy the requirements in the present invention but, in any of them, the springback value is somewhat larger than the above cases since the carbon content Cγ in the retained austenite deviates from the requirement in the present invention.

In contrast, the cases below that do not satisfy any one of the requirements stipulated in the present invention have the following drawbacks.

No. 1 is the case where the steel type A having a small C content is used. Since the C content is small, the volume fraction Vγ of the retained austenite is small, the TS×EL balance is as low as 12,000, and the workability is inferior.

Nos. 14 and 15 are the cases where the steel type E satisfying the requirements in the present invention is used but the steel sheets are produced at a high coiling temperature CT, thus the value of the expression (1) is small and the average grain size dia of the second phase structures exceeds the range stipulated in the present invention. Consequently, the TS×EL balance lowers and the springback value increases.

Nos. 18 and 19 are the cases where the steel type E satisfying the requirements in the present invention is used but the steel sheets are produced at a low soaking temperature Ts. In Table 2, the symbol "–" shown in some boxes of the soaking time is column means that the steel sheets are not retained at a soaking temperature stipulated in the present invention, and No. 18 is the case where the steel sheet is soaked at a soaking temperature of 780° C. for 10 sec and No. 19 is the case where the steel sheet is soaked at a soaking temperature of 830° C. for 10 sec. In No. 18, since the value of the expression (1) is small and the value of the expression (2) (the shortest distance dis between the second phase structures) is also small, the TS×EL balance and the shape freezing property deteriorate. Then in No. 19, the value of the expression (1) is small and the TS×EL balance and the shape freezing property deteriorate.

Meanwhile, Nos. 20 and 21 are the cases where the steel type E satisfying the requirements in the present invention is used and the steel sheets are produced at a high soaking temperature Ts. In No. 20, since the value of the expression (1) is small and the average grain size dia of the second phase structures exceeds the range stipulated in the present invention, the TS×EL balance and the shape freezing property deteriorate. Then in No. 21, since the value of the expression (1) is small and the average grain size dia of the second phase structures, the ferrite volume fraction Vf, and the retained austenite volume fraction Vγ deviate from the ranges stipulated in the present invention, the TS×EL balance and the shape freezing property deteriorate. Here, in No. 21, since the uniform elongation is lower than 10% (not shown in the table), the work hardening coefficient n value (5% to 10%) cannot be measured and hence the expression (3) cannot be computed.

Nos. 25 and 26 are the cases where the steel type E satisfying the requirements in the present invention is used but the steel sheets are produced at a low austempering temperature Ta. Since the value of the expression (1) is small and the dia value exceeds the range stipulated in the present invention, the TS×EL balance and the shape freezing property deteriorate. Here, in No. 25, since the uniform elongation is lower than 10% (not shown in the table), the work hardening coefficient n value (5% to 10%) cannot be measured and hence the expression (3) cannot be computed.

Meanwhile, Nos. 27 and 28 are the cases where the steel type E satisfying the requirements in the present invention is used and the steel sheets are produced at a high austempering temperature Ta. Since the value of the expression (1) is small and the dia value exceeds the range stipulated in the present invention, the TS×EL balance and the shape freezing property deteriorate.

No. 32 is the case where the steel type E satisfying the requirements in the present invention is used but the steel sheet is produced at a short austempering time ta. Since the values of the expressions (1) and (2) are small and the values of dia and Vf deviate from the ranges stipulated in the present invention, the TS×EL balance and the shape freezing property deteriorate. Meanwhile, No. 33 is the case where the steel type E satisfying the requirements in the present invention is used and the steel sheet is produced at a long austempering time ta. Since the value of the expression (1) is small and the values of dia and Vr deviate from the ranges stipulated in the present invention, the TS×EL balance and the shape freezing property deteriorate.

Nos. 37 and 38 are the cases where the steel type E satisfying the requirements in the present invention is used but the steel sheets are produced at low reheating temperature Tr. In No. 37, since both the expressions (1) and (2) do not satisfy the requirements in the present invention and the value dia deviates from the range stipulated in the present invention, the TS×EL balance and the shape freezing property deteriorate. In No. 38, since the expression (1) does not satisfy the requirements in the present invention and the value dia deviates from the range stipulated in the present invention, the TS×EL balance and the shape freezing property deteriorate.

Meanwhile, Nos. 39 and 40 are the cases where the steel type E satisfying the requirements in the present invention is used and the steel sheets are produced at a high reheating temperature Tr. Since the expression (1) does not satisfy the requirements in the present invention and the value Vγ deviates from the range stipulated in the present invention, the TS×EL balance and the shape freezing property deteriorate.

Nos. 44 and 45 are the cases where the steel type E satisfying the requirements in the present invention is used but the steel sheets are produced at a short reheating time tr. In No. 44, since both the expressions (1) and (2) do not satisfy the requirements in the present invention and the values of Vf, Vγ, Cγ, and dia deviate from the ranges stipulated in the present invention, the TS×EL balance and the shape freezing property deteriorate. In No. 45, since the expression (1) does not satisfy the requirements in the present invention and the values of Vf, Vγ, Cγ, and dia deviate from the ranges stipulated in the present invention, the TS×EL balance and the shape freezing property deteriorate.

Meanwhile, Nos. 46 and 47 are the cases where the steel type E satisfying the requirements in the present invention is used and the steel sheets are produced at a long reheating time tr. Since the expression (1) does not satisfy the requirements in the present invention and the value Vγ deviates from the range stipulated in the present invention, the TS×EL balance and the shape freezing property deteriorate.

No. 50 is the case where the steel sheet is produced by using the steel type G having a high Si content. Since the expression (1) does not satisfy the requirements in the present invention and the value Vγ deviates from the range stipulated in the present invention, the TS×EL balance and the shape freezing property deteriorate.

No. 51 is the case where the steel sheet is produced by using the steel type H having a high Mn content. Since the expression (1) does not satisfy the requirements in the present invention and the values of Vγ and dia deviate from the ranges stipulated in the present invention, the TS×EL balance and the shape freezing property deteriorate. Here, in No. 51, since the uniform elongation is lower than 10% (not shown in the table), the work hardening coefficient n value (5% to 10%) cannot be measured and hence the expression (3) cannot be computed.

No. 52 is the case where the steel type E satisfying the requirements in the present invention is used but the steel sheet is produced at a low soaking temperature Ts. In Table 2, the symbol "–" shown in some boxes of the soaking time is column means that the steel sheets are not retained at a soaking temperature stipulated in the present invention, and No. 52 is the case where the steel sheet is soaked at a soaking temperature of 800° C. for 10 sec. Consequently in No. 52, since the expression (1) satisfies the requirements in the present invention but the expression (2) does not satisfy the requirements in the present invention, the TS×EL balance and the shape freezing property deteriorate.

Here, although cold-rolled steel sheets are produced in the present example, it is confirmed that a hot-dip galvanized steel sheet and an alloyed hot-dip galvanized steel sheet have the same tendency and a steel sheet satisfying the requirements in the present invention is excellent in both workability and shape freezing property.

What is claimed is:

1. A cold-rolled steel sheet:

comprising, as the steel components, C: 0.10 to 0.20 mass %, Si: 0.5 to 2.5 mass %, Mn: 0.5 to 2.5 mass %, and Al: 0.01 to 0.10 mass %, iron and unavoidable impurities;

having a structure comprising a mother phase structure of ferrite and a second phase structure of retained austenite and optionally, of martensite; and satisfying the following expressions (1) and (2) where the volume fraction of the ferrite in the whole structure is represented by Vf (%), the volume fraction of the retained austenite in the whole structure is represented by Vγ (%), the carbon content in the retained austenite is represented by Cγ (mass %), the shortest distance between the second phase structures is represented by dis (μm), and the average grain size of the second phase structures is represented by dia (μm), $$(Vf \times V\gamma \times C\gamma \times \text{dis})/\text{dia} \geqq 300 \quad (1),$$

$$\text{dis} \geqq 1.0\ \mu\text{m} \quad (2);$$

wherein the tensile strength (TS (MPa))×total elongation (EL (%)) value (TS×EL) of the cold-rolled steel sheet is 20,000 or more;

and the mother phase structure of ferrite contains 70 volume % or more polygonal ferrite.

2. A cold-rolled steel sheet according to claim 1, wherein: the volume fraction Vf (%) of the ferrite in the whole structure is 60% or more; the volume fraction Vγ (%) of the retained austenite in the whole structure is 5.0% to 20%; the carbon content Cγ (mass %) in the retained austenite is 0.7% or more, and the average grain size dia (μm) of the second phase structures is 5 μm or less.

3. A hot-dip galvanized steel sheet obtained by applying hot-dip galvanizing to a cold-rolled steel sheet of claim 1.

4. An alloyed hot-dip galvanized steel sheet obtained by applying alloying hot-dip galvanizing to a cold-rolled steel sheet of claim 1.

* * * * *